US005722105A

United States Patent [19]

Thomasson

[11] Patent Number: 5,722,105

[45] Date of Patent: Mar. 3, 1998

[54] FLOOR MOP AND WRINGING MECHANISM THEREFOR

[76] Inventor: Stig Ola Thomasson, Vardavägen 235F, S-224 71 Lund, Sweden

[21] Appl. No.: 795,607

[22] Filed: Feb. 5, 1997

Related U.S. Application Data

[63] Continuation-in-part of Ser. No. 625,699, Apr. 3, 1996, abandoned.

[30] Foreign Application Priority Data

Dec. 28, 1995 [DE] Germany ..... 295 20 612 U

[51] Int. Cl.[6] ..... A47L 13/142

[52] U.S. Cl. ..... 15/120.2; 15/120.1

[58] Field of Search ..... 15/116.1, 119.1, 15/120.1, 120.2

[56] References Cited

U.S. PATENT DOCUMENTS

| | | | |
|---|---|---|---|
| 1,255,804 | 2/1918 | Shipherd | 15/120.2 |
| 1,456,696 | 5/1923 | Kelly | 15/120.1 |
| 1,710,190 | 4/1929 | Regan | 15/120.2 |
| 1,818,948 | 9/1931 | Hamblen | 15/120.2 X |
| 1,861,795 | 6/1932 | Hertzberg | 15/121 |
| 1,870,845 | 8/1932 | Goldfinger | 15/120.2 |
| 2,042,892 | 6/1936 | Granger | 15/120.2 |
| 2,230,101 | 1/1941 | Bakemeier | 15/120.2 |
| 2,365,437 | 12/1944 | Schaefer | 15/120.2 |
| 2,495,846 | 1/1950 | Johnson | 15/120.2 |
| 2,677,838 | 5/1954 | Jouban | 15/120.2 |
| 4,135,274 | 1/1979 | Freeman | 15/244.1 |

FOREIGN PATENT DOCUMENTS

| | | |
|---|---|---|
| 568977 | 4/1924 | France . |
| 570511 | 5/1924 | France . |
| 582968 | 1/1925 | France . |
| 456321 | 12/1950 | Italy . |
| 472531 | 7/1953 | Italy . |
| 110249 | 6/1925 | Switzerland . |
| 91/19450 | 2/1991 | WIPO . |

OTHER PUBLICATIONS

Expressen, 12 Feb. 1995.

*Primary Examiner*—Mark Spisich
*Attorney, Agent, or Firm*—Fasth Law Firm

[57] ABSTRACT

A floor mop has a stick 10, a mop head 11 including a mop fabric 12 and an lower handle 14 and an upper handle 19. The lower handle is axially and rotatably movable relative to the stick 10 and is attached to one end of the mop fabric 12 of the mop head. The other end of the mop fabric is non-rotatably attached to a lower end of the stick 10. The upper handle 19 is attached to a sleeve 16 that is mounted on the stick 10 to enable the rotation of the stick relative to the lower handle 14 to wring the mop fabric 12 of the mop head. According to the present invention, the upper handle movably engages the sleeve 16 via a protrusion that extends into a helical groove 17 defined in the sleeve 16. The helical groove may have a slope that is gradually reduced as the helical groove extends from an upper portion of the sleeve to a lower portion of the sleeve.

16 Claims, 2 Drawing Sheets

FIG.8
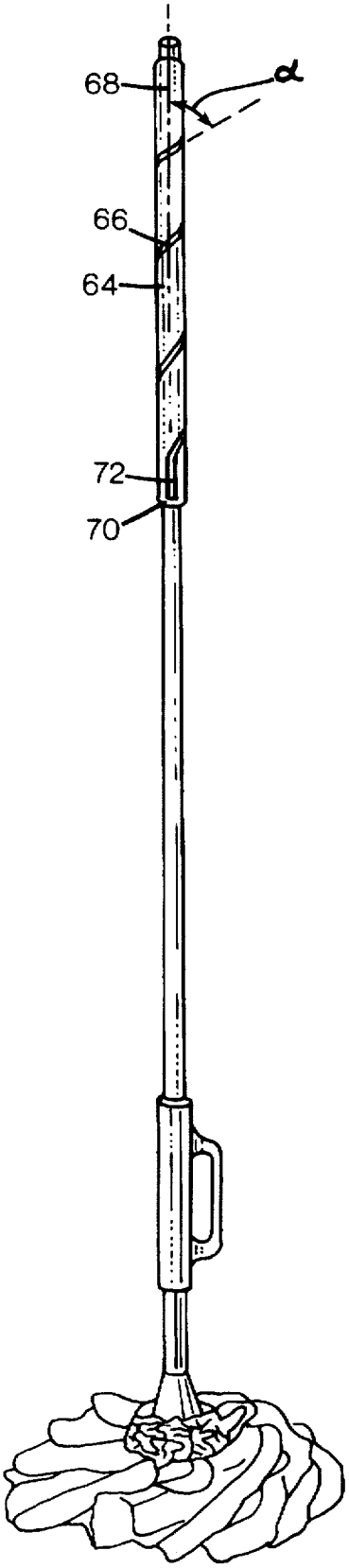
FIG.9
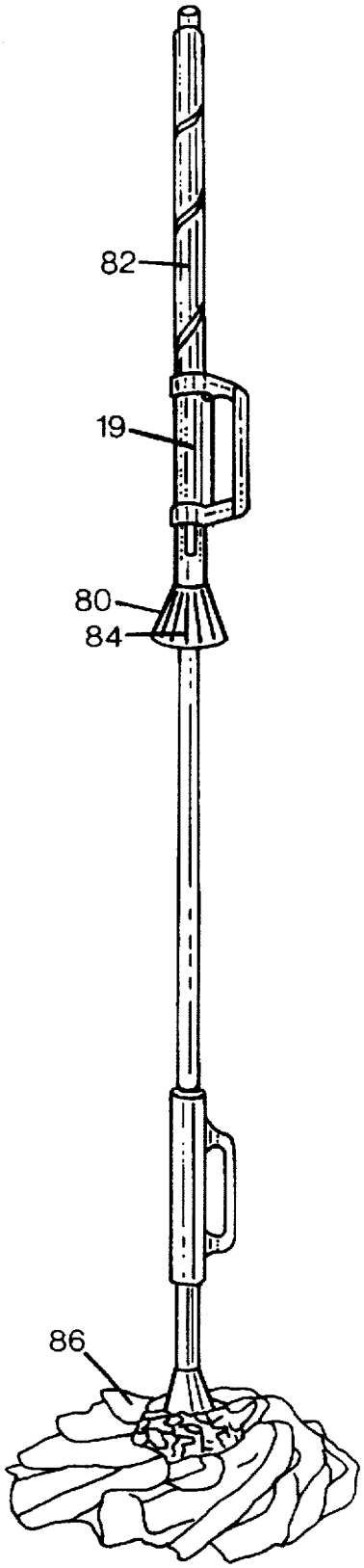
FIG.10
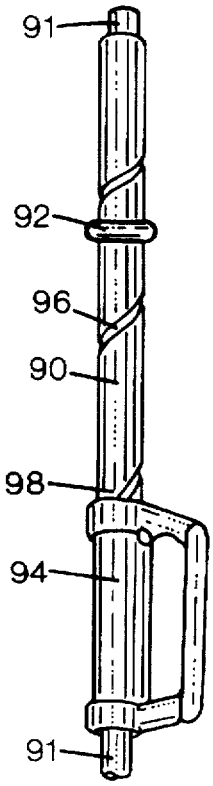
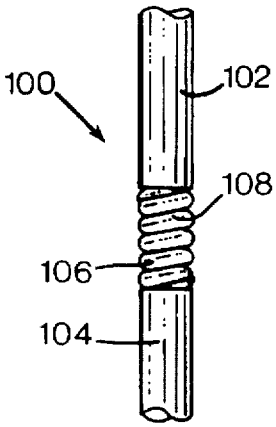
FIG.11

FLOOR MOP AND WRINGING MECHANISM THEREFOR

PRIOR APPLICATION

This is a continuation in part application of patent application Ser. No. 08/625,699 filed on 3 Apr., 1996, abandoned.

TECHNICAL FIELD

The present invention relates to a floor mop having a novel sleeve for wringing a mop fabric and to the sleeve as an accessory to floor mops.

BACKGROUND INFORMATION AND SUMMARY OF THE INVENTION

The present invention relates to an improved floor mop. The prior art mops include a stick; a mop head having mop fabric; and a lower handle. The lower handle is axially and rotatably movable relative to the stick and is attached to one end of the mop fabric of the mop head. The other end of the mop fabric is non-rotatably secured to a lower end of the stick. The mops further include an upper handle that is attached to the stick so that the upper handle is rotatable relative to the lower handle to wring the mop fabric of the mop head. This type of floor mop is commonly referred to as a twister mop and is sold in large quantities under the SMARTMOP trademark and is very successful. When employing this mop during cleaning, the lower handle is lowered so that the mop fabric of the mop head has a rosette shaped appearance. When the mop head is later cleaned, the mop head is immersed into a liquid or into rinsing water. To wring the liquid out of the mop, the mop fabric of the mop head is stretched by moving the lower handle upwardly so that the mop fabric is substantially parallel to the stick. The lower handle is then rotated about the stick so that the lower handle and the upper handle are rotated in opposite directions. The result is that the mop fabric is pressed against the stick during rotation so that the mop fabric is tightly twisted and extends in a helical path about the stick. The rinsing and wringing procedure can then be repeated if it is necessary or desirable.

This prior art floor mops have the drawback of being difficult to wring, particularly for those who have weak hand strength. Additionally, the method of wringing the mop is relatively difficult and time consuming and the procedure is divided into steps requiting changes of the grip. When the grip is shifted from one grip to another it is very difficult to maintain the partial wringing of the mop that has already been accomplished.

Another problem of the prior art mops is that the twisting of the mop fabric of the mops is initiated before the strips are stretched which reduces the effect of the wringing operation.

One objective of the present invention is thus to improve the prior art floor mops.

The floor mop of the present invention includes a stick, a mop head of mop fabric and a lower and an upper handle. The lower handle is axially and rotatably movable relative to the stick and is attached to one end of the mop fabric of the mop head. The other end of the mop fabric is non-rotatably secured to the lower end of the stick. The upper handle is attached to a sleeve attached to an upper portion of the stick. The sleeve has a helical groove defined therein to enable a rotation of the stick relative to the lower handle by longitudinally moving the upper handle in the helical grooves to wring the mop fabric of the mop head. In particular, the upper handle has a protrusion that is adapted to engage the helical groove to rotate the sleeve, and thus the mop stick, by axially moving the handle toward the mop fabric. In other words, the sleeve and the upper handle are to convert a translational movement of the handle along the stick to a rotational movement by the stick. In the preferred embodiment of the mop of the present invention, a downward translational movement of the upper handle is used. This downward movement has shown to be ergonomically more suitable, especially if the user has weak hands.

The grooves of the present invention are not defined in the mop stick itself. This has many notable advantages. For example, the sleeve may be mounted to existing mops of the customary type available and is independent from the configuration of the mops with regard to the mop head and the attachment of the mop head to the rest of the mop as long as the basic principles of the function of the mop are according to the mops described above. A significant hygienic and functional advantage is the position of the wringing mechanism because the rinsing water never comes in contact with the mechanism.

In the most preferred embodiment of the mop of the present invention, the wringing mechanism includes a sleeve and a protrusion extending radially inwardly from the upper handle to operatively engage the helical groove of the sleeve so that the stick may be rotated by shifting the upper handle along the sleeve. If the present invention is provided as an wringing accessory to the earlier described prior art mop, this accessory includes the upper handle, sleeve and the protrusion extending therefrom so that the protrusion is in operative engagement with the helical groove of the sleeve.

When it is desirable to wring the mop, the whole mop may be lifted by the upper handle so that the whole mop is rotated as a result of the upper handle being moved within the helical groove of the sleeve. The lower handle is then moved upwardly so that the mop fabric of the mop head is stretched and aligned parallel to the stick. Both handles are then shifted or moved towards one another. In this way, the stick is rotated relative to the mop fabric of the mop head that is attached to the lower handle. The result is an automatic wringing when both handles are moved towards one another. If it is then desirable to rinse the mop fabric again, the twisted mop head is immersed and the lower handle is released while the upper handle is lifted so that the sleeve rotates in the opposite direction while the protrusion is moved within the helical groove of the sleeve. The result is that the mop fabric is released from the stick and is again formed into a rosette shape while the fabric is being rotated in the rinsing water. The wringing process may then be repeated.

BRIEF DESCRIPTION OF THE DRAWINGS

FIG. 8 is a perspective view of an alternative embodiment of the present invention showing a helical groove with a gradually declining slope.

FIG. 9 is a detailed view of an alternative embodiment of the present invention including a sleeve having a conical portion.

FIG. 10 is a sectional view of an alternative embodiment of the present invention showing at stopper on the sleeve.

FIG. 11 is a detailed view of a mop stick of the present invention having a bendable mechanism that is biased to be in a straight position by a spring member.

DETAILED DESCRIPTION OF PREFERRED EMBODIMENTS

Figure 1:
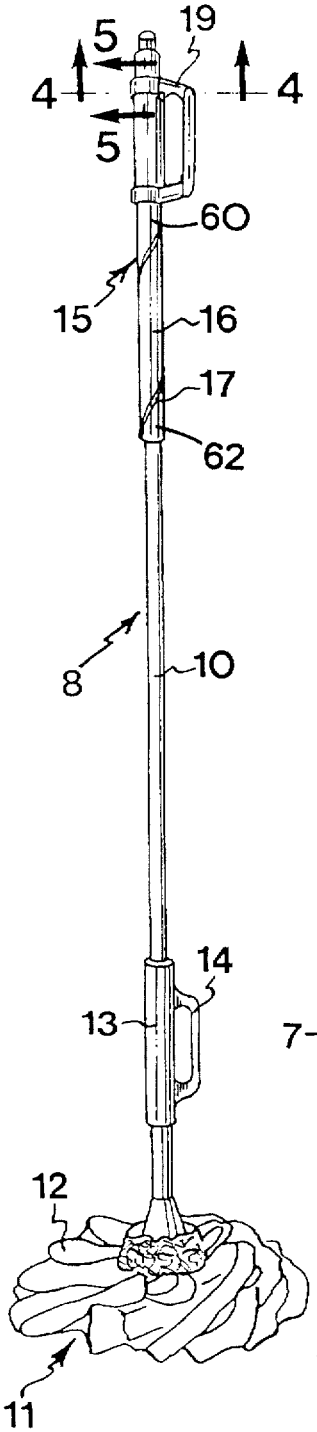
FIG. 1 is a perspective view of an embodiment of the mop of the present invention wherein the mop is in an operational mode.
Figure 2:
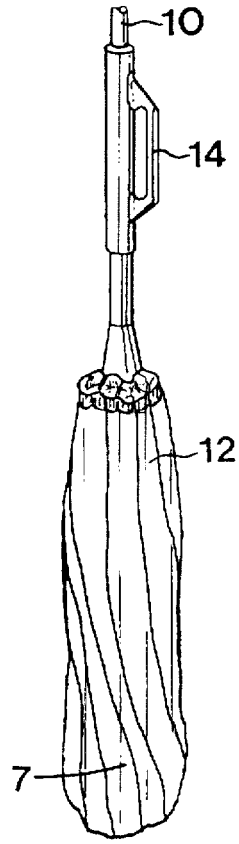
FIG. 2 is a perspective view of a portion of the same mop wherein the mop fabric is in an extended position.
Figure 3:
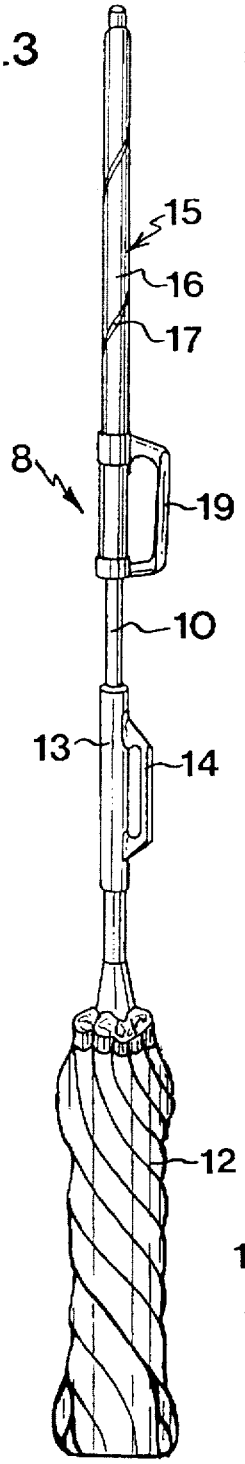
FIG. 3 is a perspective view of the mop wherein the mop fabric is twisted about the stick.

The mop 8 illustrated in the FIGS. 1–5 includes an elongate stick 10. A mop head 11 is attached to a lower end of the stick. Highly absorbent mop fabric 12 has one end 7 attached to the lower end of the stick and the other end is attached to a sleeve 13. The sleeve 13 is freely shiftable along and rotatable about the stick 10. A lower handle 14 is also attached to or is integrally formed with the sleeve 13 to make it easier to operate the mop. In a prior art mop, an upper handle may be rigidly secured to the stick 10 at a distance of about 35 centimeters from an upper end of the stick. According to the preferred embodiment of the present invention, this handle has been replaced with an upper handle 19 that is adapted to be in operative engagement with an elongate sleeve 16 that is secured to the mop stick 10 that is described in detail below.

In the preferred embodiment of the present invention, the sleeve 16 has a helical groove 17 defined therein that extends from an upper portion 60 to a lower portion 62 of the sleeve 16. An important feature of the sleeve 16 together with the upper handle 19 in operative engagement therewith is that they may be mounted to a conventional twister mop stick (such as the SmartMop mop stick) as an accessory. The sleeve 16 should be made sufficiently long so that the lower portion 62 of the sleeve covers the screw holes for mounting the prior art upper handle so that the holes may be used to attach the sleeve 16. The sleeve 16 may be made of a wide variety of materials including a plastic material that is suitable for conventional plastic forming processes. For example, a low friction plastic may be used to form the sleeve 16 to make it easy to slide the handle 19 on the sleeve 16. This is one of the many advantages of having the groove defined in the sleeve, as opposed to directly in the mop stick itself. It is often not practical to mold the whole mop stick out of plastic. By using a sleeve that is mounted on the mop stick it is possible to select a material that is optimal for the wringing mechanism without having to take other considerations into account. A relatively thick sleeve improves the mechanical strength of the sleeve 16. Another advantage of defining the helical groove or grooves in the sleeve (as opposed to defining the grooves directly in the stick itself) is that the diameter of the sleeve 16 may be adjusted to the user without having to make the whole stick of a thicker diameter. A thick stick is not only more expensive to make but also heavier. Additionally, if the helical groove of the sleeve is damaged, it is only necessary to replace the sleeve and not the whole stick.

A protrusion 18 (see FIG. 4) is disposed on an inside of the upper handle 19 so that the protrusion is in operative engagement with the helical groove 17 defined on an outside surface of the sleeve 16 and so that the stick 10 is rotatable when the upper handle 19 is axially or longitudinally shifted along the sleeve 16.

The slope of the helical groove may preferably vary along the length of the sleeve. As best seen in FIG. 8, a sleeve 64 has a helical groove 66 defined therein. The sleeve 64 has an upper portion 68 and a lower portion 70. The slope has an angle alpha at the upper portion 68 that is approximately 45 degrees relative to the longitudinal axis of the sleeve 64. It is to be understood that the angle alpha may be more or less than 45 degrees. The angle of the helical groove 66 is gradually reduced as the helical groove extends from the upper portion 68 to the lower portion 70. The helical groove 66 may have a lower end segment 72 that is substantially parallel to the longitudinal axis of the sleeve 64. The mop fabric provides more and more resistance as the upper handle is moved axially downwardly to wring the mop fabric. The gradual reduction of the angle of the slope of the helical groove reduces the effort required to wring the mop fabric. When the handle reaches the lower end segment 72, the user may twist the upper handle in a direction that is perpendicular to the longitudinal axis of the mop stick to give the mop fabric a last hard squeeze to tightly wring the remaining water out of the mop fabric.

In an alternative embodiment, the helical groove may be a helical ridge that extends along the sleeve and protrudes radially outwardly. If a helical ridge is used, then the upper handle has either a relatively short conventional straight groove or a short helical groove defined therein to operatively engage the helical ridge.

The mop may include a snap locking mechanism 24 at the upper end of the handle 19 so that the handle may be temporarily locked at the upper end of the sleeve when the mop is used for cleaning a floor. The locking mechanism includes a shallow inner circumferential groove 20 defined on an inside of the collar shaped portion of the handle 19. The locking mechanism also includes a low and rounded circumferential ridge 21 disposed on the outside of the sleeve 16.

With reference to FIG. 9, a lower portion 80 of a sleeve 82 may include a conical shaped bottom portion 84 to make it easier to twist the sleeve relative the mop fabric 86 to be wrung. The conical portion 84 has a large diameter that improves the leverage force and thereby the twisting strength of the user. The lower portion 80 of the sleeve 82 may have two diametrically opposed wings instead of being conical so as to increase the leverage of the sleeve when it is rotated to wring the mop fabric.

With reference to FIG. 10, a sleeve 90, attached to a stick 91, is shown having a movable stopper 92 that is removably attached to the sleeve 90. The stopper 92 may be ring shaped and functions to prevent a handle 94 from passing the stopper 92 when the handle 94 is moved upwardly and is guided by a helical groove 96 defined in the sleeve 90. The stopper 92 may be attached to the sleeve 90 at different places on the sleeve 90 depending on how much rotation is desired when the handle 94 is longitudinally moved along the sleeve, as described above, to rotate a mop fabric attached to a lower end of the stick 91. If the stopper 92 is positioned relatively close to a lower end 98 of the sleeve 90 then the mop fabric is rotated less and remains wetter after the wringing procedure has been carried out. It is also easier to rotate the mop fabric by preventing the handle 94 from being withdrawn all the way to the top of the sleeve 90 because the handle 94 is moved a shorter distance during the wringing procedure before the handle hits the bottom of the helical groove 96 and the slope of the groove is such that it is relatively easy to rotate the mop fabric attached to the bottom of the mop stick.

With reference to FIG. 11, an alternative embodiment of the present invention is shown. A straight mop stick 100 is divided into an upper part 102 and a lower part 104 that are joined by a bending mechanism 106. The bending mechanism 106 may be a spring 108 or a rubber joint that enables bending of the mop stick 100 to reach places that are difficult to clean, such as under furniture, without requiring the user to bend down to reach underneath the furniture. The bending mechanism 106 may be constructed so that the bending mechanism is biasing the mop stick into the straight position. The bending mechanism is particularly useful for users, such as elderly and handicapped individuals, who may find it difficult to bend down.

When using the mop of the present invention for cleaning, the various components are preferably positioned as is shown in FIG. 1. However, it is not necessary for the handle 19 to be temporarily locked in its upper position because the handle may also be disposed in a lower position on the sleeve 16. When the mop is to be wrung, the handle 19 is moved to its upper position (see FIG. 1), unless the handle is already temporarily locked into this position, the handle 14 is then lifted so that the mop fabric of the mop head is extended along the stick (see FIG. 2).

If the mop head is immersed into water only and the upper handle is gripped and moved from its lower position to its upper position then the mop head and the mop fabric are rotated by this upward movement of the handle 19. This rotation facilitates the rinsing and removal of dirt from the mop fabric. Then the handle 14 is pulled upwardly in order to stretch the mop fabric. The next step is to push the handle 19 downwardly in the direction towards the handle 14. As a result, the sleeve 16 and thus the stick 10 and the lower end of the mop head is rotated relative to the lower sleeve 13 and thus relative to the upper end of the mop head. The mop fabric is therefore twisted into a spiral shape about the stick 10 and the strips of the mop fabric are forcefully wrung. The effect of this wringing procedure is extra high because the mop fabric is already extended before the wringing is started. Because the wringing is accomplished by the sleeve 16 including the protrusion 18 and the helical grooves 17 so that the protrusion 18 is guided in the helical groove 17 and not through a manual twisting of the handles 14 and 19 relative to one another (as is required in the mop sold under the SMARTMOP trademark), it is easier for persons having weak hand strengths and muscles to achieve good wringing results. In addition, it is not necessary to change the grip during the wringing procedure to sufficiently rotate the stick 10 and the sleeve 13 relative to one another to achieve the desired wringing result.

As is apparent from the above description, the present invention is a substantially improvement over the prior art mops. The present invention may be provided as a completely new and fully equipped floor mop including the wringing mechanism or as a separate wringing accessory that is adapted to be mounted on the prior art mops of the type represented by the mop that is sold under the SMARTMOP trademark and similar mops.

The figures only show examples of embodiments of the present invention. Another possible alternative embodiment of the present invention is to switch the position of the helical groove 17 and the protrusion 18, that is the helical groove 17 defined on the inside of the sleeve shaped portion of the handle 19 (which in that case must be extended) and the protrusion 18 is attached directly to the stick 10. To achieve the full effect of the invention, it is thus required that the stick 10 and the handle 19 are attached to one another with the assistance of a helical groove and a protrusion. Other modifications are obviously possible within the scope of the invention.

According to the above described embodiments the sleeve and the protrusion have been employed to convert the translational movements to rotational movements. If desired, other mechanisms may be used to accomplish this conversion even though mechanisms based on a sleeve and a protrusion are often the easiest and the least expensive. Another possible embodiment is a mechanism for convening translational movements to rotational movements such as a conversion mechanism including two or more rolls that a) includes a friction surface or a friction promoting surface configuration, b) are disposed at the upper handle, c) are under load in the direction toward the stick and d) have their axles angled in the same direction relative to the longitudinal axis of the stick so that when the upper handle is shifted along the stick, the stick is caused to rotate. The rolls may in this case be attached to the upper handle via a pressure adjusting mechanism having a sloping cam surface to engage a complimentary cam surface on a roll holder to increase the application pressure of the rolls against the stick or the sleeve. This occurs when the handle is shifted in one direction and the pressure is reduced when the handle is shifted in the other opposite direction along the stick. It is also possible to design the sleeve 16 so that it has a shape that is not round. For example, the sleeve may have a polygon shaped cross section that is in operative engagement with the handle in such a way that the shifting of the handle in the axial direction also causes the stick to rotate.

Figure 6:
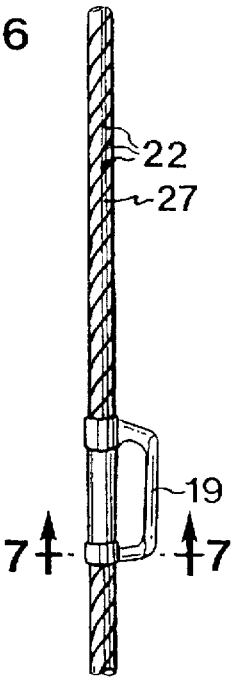
FIG. 6 is a perspective view of a potion of the mop illustrating a plurality of helical grooves defined in the stick.
Figure 7:
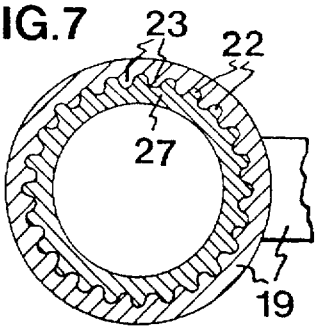
FIG. 7 is a cross sectional view along line 7—7 of FIG. 6.
Figure 5:
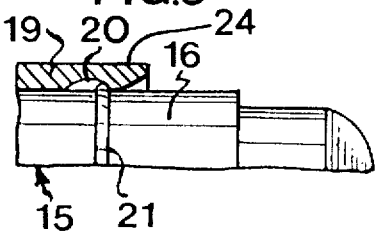
FIG. 5 is a cross sectional view along line 5—5 of FIG. 1.
Figure 4:
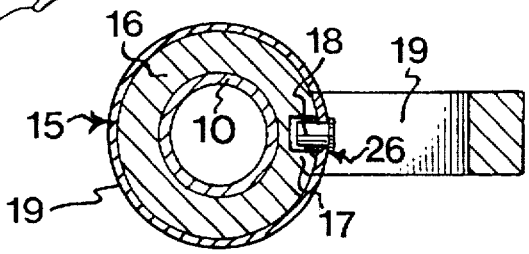
FIG. 4 is a cross sectional view along line 4—4 of FIG. 1.

An alternative embodiment of the above cross section of the stick 10 or a sleeve attached to the stick is shown in FIGS. 6 and 7. In the illustrated embodiment, at least one land portion 22 is formed on a component 27 such as a sleeve mounted on the stick. Additionally, a handle includes at least one helical groove 23 defined on the inside of the handle to operatively engage and cooperate with the land portion 22. The slope of the helical grooves preferably varies along the length of the wringing mechanism. In general, this alternative embodiment functions in the same way as the earlier described embodiment, as shown in FIGS. 1–5.

While the present invention has been described with reference to preferred embodiments, it is to be understood that certain substitutions and alterations may be made thereto without departing from the spirit and scope of the invention as set forth in the appended claims.

I claim:

1. A floor mop comprising:

a stick having a lower end, an opposite upper end and a longitudinal axis extending therebetween;

a mop head including a mop fabric, the mop fabric having a first end and an opposite second end;

a lower handle disposed at the lower end of the stick and the first end of the mop fabric, the lower handle being axially and rotatably shiftable relative to the stick, the second end of the mop fabric being secured to the lower end of the stick;

a sleeve mounted to the upper end of the stick, the sleeve having a helical groove defined therein and an upper handle rotatably attached to the sleeve and in operative engagement with the helical groove of the sleeve so that longitudinal shifting of the upper handle is converted to rotational movement of the stick to wring the mop fabric of the mop head.

2. A floor mop according to claim 1 wherein the upper handle has a protrusion adapted to operatively engage the helical groove defined in the sleeve to rotate the stick when the upper handle is shifted along the longitudinal axis of the stick and the protrusion is guided by the helical groove.

3. A floor mop according to claim 2 wherein the sleeve has a movable stopper extending radially outwardly, the stopper is adapted to prevent the upper handle from passing the stopper when the protrusion of the upper handle is in operative engagement with the helical groove of the sleeve.

4. A floor mop according to claim 1 wherein the helical groove has a slope that is varied so that the slope has a first slope at an upper portion of the sleeve and a second slope at a lower portion of the sleeve and the first slope is different from the second slope.

5. A floor mop according to claim 4 wherein the helical groove includes a lower segment that is substantially parallel with the longitudinal axis of the stick at a lower portion of the sleeve.

6. A floor mop according to claim 5 wherein the lower portion of the sleeve has a conical section, the lower segment of the groove is disposed between an upper portion of the sleeve and the conical section of the sleeve, the conical section has a diameter that is greater than a diameter of the sleeve.

7. A floor mop according to claim 1 wherein the sleeve includes a locking mechanism for temporarily locking the upper handle to the sleeve.

8. A floor mop according to claim 1 wherein the sleeve includes a plurality of helical grooves defined therein and the upper handle includes a plurality of land portions that are adapted to operatively engage the helical grooves.

9. A floor mop according to claim 1 wherein the stick is divided into an upper part and a lower part that are joined together by a bendable mechanism to permit the upper part to bend relative to the lower part at the bendable mechanism, the bendable mechanism is biased to move back from a bent position to a straight position.

10. A floor map according to claim 9 wherein the bendable mechanism is a spring that is attached to both the upper part and the lower part and the spring is biasing the stick into a straight position.

11. A wringing mechanism that is mountable on an elongate floor mop stick, the wringing mechanism comprising:

an elongate cylindrical sleeve having a longitudinal opening defined therethrough, the elongate sleeve having a lower portion and an upper portion, the longitudinal opening having a diameter that is adapted to receive a floor mop stick secured therein, the sleeve having an outside surface, the outside surface having a helical groove defined therein, the helical groove having a varied slope so that the slope at the upper portion of the sleeve is different from the slope of the helical groove at the lower portion of the elongate sleeve; and a handle in operative engagement with the outside surface of the elongate sleeve, the handle having an internal protrusion extending radially inwardly, the protrusion being adapted to operatively engage the helical groove of the sleeve to permit rotation of the sleeve when the handle is moved longitudinally along the outside surface of the cylindrical sleeve and the protrusion is engaging the helical groove.

12. The wringing mechanism of claim 11 wherein the elongate sleeve has a movable stopper device disposed thereon, the stopper device extends laterally around the elongate sleeve to prevent the handle from passing the stopper device when the handle is moved upwardly along the longitudinal axis of the sleeve.

13. The wringing mechanism of claim 11 wherein the floor mop stick has a mop fabric attached to one end of the floor mop stick that is wrung when the handle is longitudinally shifted along the elongate sleeve to rotate the elongate sleeve.

14. The wringing mechanism according to claim 11 wherein the wringing mechanism includes a locking mechanism for locking components of the wringing mechanism to one another and to lock the handle to the elongate sleeve.

15. A floor mop comprising:

an elongate stick having upper and lower ends and a longitudinal axis;

a mop head including a mop fabric, the mop fabric having a first end and an opposite second end;

a lower handle disposed at the lower end of the elongate stick and movably attached to the first end of the mop fabric, the lower handle being axially and rotatably movable relative to the stick, the lower handle being slidable along the longitudinal axis of the stick, the second end of the mop fabric being secured to the lower end of the stick;

a sleeve secured to the upper end of the elongate stick and remote from the mop head, the sleeve having an upper portion and a lower portion;

a helical groove defined in the sleeve, the helical groove having a first slope at the upper portion of the sleeve and a second slope at the lower portion of the sleeve, the first slope being different from the second slope so that the helical groove has a slope that is gradually reduced from the upper portion of the sleeve to the lower portion of the sleeve, the helical groove having a lower segment at the lower portion of the sleeve that is substantially parallel to the longitudinal axis of the elongate stick;

an upper handle having an inside in operative engagement with the sleeve, the upper handle being axially and rotatably movable relative to the sleeve and the lower handle; and a protrusion member attached to the upper handle to protrude radially inwardly into the helical groove, the protrusion member being adapted to operatively engage the helical groove to rotate the stick and the sleeve attached thereto so that the mop fabric is wrung from a substantially parallel extended position to a twisted position when the upper handle is axially moved downwardly along the length of the sleeve towards the lower end of the stick.

16. A floor mop according to claim 15 wherein the floor mop further comprises a circumferential recess defined in the upper handle and a circumferential ridge protrudes radially outwardly from the sleeve, the ridge being adapted to fit inside the recess to releasably lock the upper handle relative to the sleeve.

* * * * *